US007057597B2

(12) United States Patent
Ikeda

(10) Patent No.: US 7,057,597 B2
(45) Date of Patent: Jun. 6, 2006

(54) LIQUID CRYSTAL DISPLAY APPARATUS AND DRIVING METHOD

(75) Inventor: Hiroyuki Ikeda, Kanagawa (JP)

(73) Assignee: Sony Corporation (JP)

( * ) Notice: Subject to any disclaimer, the term of this patent is extended or adjusted under 35 U.S.C. 154(b) by 442 days.

(21) Appl. No.: 10/404,055

(22) Filed: Apr. 2, 2003

(65) Prior Publication Data

US 2003/0218587 A1 Nov. 27, 2003

Related U.S. Application Data

(62) Division of application No. 09/816,213, filed on Mar. 26, 2001, now Pat. No. 6,683,595.

(30) Foreign Application Priority Data

Mar. 29, 2000 (JP) ..... P2000-090283

(51) Int. Cl.
*G09G 3/36* (2006.01)

(52) U.S. Cl. ..... 345/95; 345/92; 345/210

(58) Field of Classification Search ..... 345/88–103, 345/690–693, 589, 204, 208–210
See application file for complete search history.

(56) References Cited

U.S. PATENT DOCUMENTS 4,752,826 A * 6/1988 Barnett ..... 348/441
5,473,381 A 12/1995 Lee
5,724,058 A * 3/1998 Choi et al. ..... 345/89
6,151,075 A 11/2000 Shin et al.
6,215,469 B1 * 4/2001 Mori et al. ..... 345/691
6,310,677 B1 * 10/2001 Togano et al. ..... 349/172
6,335,735 B1 * 1/2002 Denda et al. ..... 345/589
6,344,839 B1 2/2002 Denda et al.
6,473,077 B1 10/2002 Takenaka et al.

* cited by examiner

*Primary Examiner*—Lun-yi Lao
(74) *Attorney, Agent, or Firm*—Rader, Fishman & Grauer PLLC; Ronald P. Kananen

(57) ABSTRACT

An object of the invention is to improve the moving-picture quality of an active matrix type liquid crystal display apparatus. The apparatus comprises liquid crystal pixels disposed in a matrix configuration, a line drive circuit sequentially scanning each line of the pixels at every frame repeating with a predetermined frequency, and a column drive circuit writing an image signal into the pixels in sync with the sequential scanning. The frame is divided into a preceding and following sub-frame. The line drive circuit scans sequentially for the preceding and a following sub-frame. The column drive circuit writes an image signal originally assigned to a frame into the pixels for the preceding sub-frame, and then writes an image signal for adjusting the image quality into the pixels for the following sub-frame. The image signal for adjusting the image quality is obtained by operating the image signal assigned to the frame and an image signal assigned to the next frame.

4 Claims, 10 Drawing Sheets

LIQUID CRYSTAL DISPLAY APPARATUS AND DRIVING METHOD

This is a divisional application of Ser. No. 09/816,213, filed on Mar. 26, 2001 now U.S. Pat. No. 6,683,595.

BACKGROUND OF THE INVENTION

1. Field of the Invention

The present invention relates to an active matrix type of liquid crystal display apparatus and a driving method for the same. In particular, the present invention relates to a driving technique to for improving the quality of a moving picture image.

2. Description of the Related Art

FIG. 8 is a perspective figure showing a configuration of the active matrix type liquid crystal display apparatus of the related art. As shown in FIG. 8, the display apparatus of the related art has a panel structure comprising a pair of insulator substrates 101, 102 and a liquid crystal 103 held in between those two substrates. A pixel array unit 104 and a drive circuit unit are fabricated and integrated on the insulator substrate 101 disposed at the lower side. The drive circuit unit consists of a line drive circuit 105 and a column drive circuit 106. A terminal unit 107 for an external connection is fabricated on an upper part of a peripheral area of the insulator substrate 101. The terminal unit 107 is connected to the line drive circuit 105 and the column drive circuit 106 via wiring 108. Gate wiring 109 in a line form and signal wiring 110 in a column form are fabricated in the pixel array unit 104. A pixel electrode 111 and a thin film transistor (TFT) 112 for driving the pixel electrode 111 are fabricated at an intersection of the gate wiring 109 and the signal wiring 110. A gate electrode of the thin film transistor 112 is connected to a corresponding gate wiring 109, a drain region to a corresponding pixel electrode 111, and a source region to a corresponding signal wiring 110. The gate wiring 109 is connected to the line drive circuit 105, and the signal wiring 110 is connected to the column drive circuit 106.

Due to technical advancements in devices, process and fabrication, the active matrix type liquid crystal display (LCD) apparatus with a size up to a twenty inch class may now be realized now. In addition, displays having brighter and fine picture quality are being developed. Furthermore, improvements are also being made in order to solve problems relating to the narrow viewing angle of the liquid crystal display (LCD), which is considered one of the drawbacks in the LCD, by implementing technologies such as switching of liquid crystal molecules with an electric field along a substrate plane direction (so called in-plane switching), by combining of a liquid crystal alignment direction division and a vertical alignment (so called multiple vertical alignment), or by using a phase shift correction film. The problems related to the viewing angle are such that the viewing angle of the LCD in which more than a reasonable contrast can be obtained is narrower than that of a CRT, and a negative-positive inversion may occur locally for a gray scale image display. Furthermore, according to advancements in production technologies, the cost of the LCD has been cut considerably such that even a twenty inch class LCD television is now coming into practical use. With the use of these technologies mentioned above, a picture quality of the LCD has become comparable and even superior to that of the CRT as far as a still picture image is concerned.

However, various drawbacks of the LCD remain to be solved. One is the image quality of a moving picture. That is, the LCD may not be able to generate clear outlines of moving pictures and the moving pictures displayed on the LCD screen may smear. For example, in an extreme case, a trailing tail image of a pitched ball may be appear on the LCD screen during a baseball game broadcasting. Such an extreme case is now being resolved due to technical advancements in liquid crystal materials.

Quantitatively, a total period (i.e. response time) of a rise time for horizontally oriented liquid crystal molecules to be risen by a certain electric field, and a fall time for the risen liquid crystal molecules to go back to their original orientation with null electric field is reduced to as short as about 30 msec due to technical improvements. Presently, liquid crystal molecules are driven to rise or fall at the beginning of every 33.3 msec frame period for the LCD with a 30 Hz frame frequency. In other words, the response characteristic of the LCD has been improved such that the liquid crystal molecules can be driven to follow the frame frequency without any difficulties.

However, the problem of clarity of the moving picture outlines remains unsolved. This problem may not be improved even by further development of liquid crystal materials with shorter response times, nor by further improvements in orientation technology. An underlying cause of the problem is based on a fundamental principle of the active matrix type LCD, and reported in "Improving the Moving-Image Quality of TFT-LCDs" at the International Display Research Conference (IDRC), 1997.

FIG. 9 is a schematic view illustrating the problem of moving image quality of an active matrix type LCD of the related art. Image data for each frame is shown on the left hand side of FIG. 9, and the visual picture appears on a display screen (hereafter, called visual screen image), as shown on the right hand side of FIG. 9. An image data SIG1 at a frame 1 shows, for example, an alphabetical character of X. The next frame (frame 2) also shows the same character X except with a slight shift toward the right hand side. The bottom frame (frame 3) also shows the character X shifting toward a bottom-left direction. On the other hand, residual images (shadows) may appear in the visual screen image, which are actually recognized by human eyes, when the frame changes from frame 1 to frame 2, and when frame 2 changes to frame 3. Because of these shadows, the problem surrounding the capability of displaying moving images on active matrix type LCDs of the related art remains.

FIG. 10 is a waveform diagram schematically showing a driving method of the active matrix type LCD of the related art shown in FIG. 9. In general, the LCD is driven in an AC mode. Accordingly, each frame (for example frame 1) is divided into a field 1 and a field 2, and the LCD is interlace driven. In frame 1, image data SIG1 is written into liquid crystal pixels for a period of field 1 and field 2. In the next frame (frame 2), image data SIG2 is similarly written into the liquid crystal pixels for a period of field 1 and field 2. The image data written into each liquid crystal pixel is kept during the frame pertaining to the active matrix type driving method. When the frame is changed to the next frame, the image data is re-written instantaneously. Namely, the image data is suddenly switched between frame 1 and frame 2, whereby causing the residual image phenomenon. Human eyes recognize the residual image during switching of the frames in which, for example, the liquid crystal pixel written-in the white at frame 1 is switched to the black at frame 2.

The brightness of the image shown on the CRT screen attenuates in an order of a microsecond. In contrast, a fundamental principle of a display method for the LCD is to keep the same display image for an entire frame. The LCD displays the same image until the switching of the frames starts. This will be added to the residual image phenomenon of human eyes as described above. Accordingly, the residual image may still be recognized even after the frame has been changed, despite the ultimate advancement of the response characteristics of the liquid crystal material. This remains the fundamental problem surrounding the moving image quality of the active matrix type LCD.

To solve this problem, utilization of an "OBC mode" technique is suggested by the report mentioned above to improve the moving image quality. The OBC mode technique is a technology for cutting the residual image recognized by the human eyes and is based on the assumption that the liquid crystal response time is about 5 msec. For example, in the transmission type LCD, a back light is blinked within a single frame so as to display an image at the former part of the frame and tune the back light off at the latter part, thereby inducing a phenomenon similar to the fast attenuation of the CRT brightness. However, there are some drawbacks in this technique. For one thing, the contrast of the LCD is decreased since the blinking of the back light causes a decrease in the average luminosity and darkens the screen. Furthermore, power consumption and production costs will increase due to the intermittent drive of the back light. Furthermore, the technique can not be applied to a reflection type LCD, which is widely used in the present days. Some improvements are reported in "A Novel Wide-viewing-Angle Motion-Picture LCD", Society of International Display, 1998 regarding problems on the back light power consumption and its application to the reflection type LCD. However, the report did not provide solutions to the problems surrounding the brightness and contrast of the LCD.

SUMMARY OF THE INVENTION

The present invention is carried out by taking into account the above mentioned problems relating to the conventional technology. An object of the present invention is to provide an active matrix type liquid crystal display apparatus capable of improving the image quality of motion pictures displayed thereon. The following is provided to attain the object of the present invention. According to an embodiment of the present invention, there is provided a driving method of a liquid crystal display apparatus including a plurality of liquid crystal pixels disposed in a row-column matrix configuration, a line drive circuit sequentially scanning each line of the liquid crystal pixels at every frame repeating with a predetermined frequency, and a column drive circuit writing image signal into the liquid crystal pixels in sync with the sequential scanning, comprising the steps of dividing every frame into a preceding sub-frame and a following sub-frame, performing sequential scanning for the preceding sub-frame and performing sequential scanning again for the following sub-frame, and writing an image signal originally assigned to a frame pertain into the liquid crystal pixels in sync with the sequential scanning for the preceding sub-frame and writing an image signal for adjusting image quality into the liquid crystal pixels in sync with the sequential scanning for the following sub-frame. The image signal for adjusting image quality is obtained by operating the image signal originally assigned to the frame pertain and an image signal assigned to a frame following the frame pertain. Alternatively, an image signal for adjusting image quality, which may be obtained by averaging the image signal originally assigned to a frame pertain and an image signal assigned to a frame following the frame pertain, is written into the liquid crystal pixels. Furthermore, the image signals may be written into liquid crystal pixels having a response characteristic of 10 msec or less.

Furthermore, according to an embodiment of the present invention, there is provided a driving method of a liquid crystal display apparatus including a plurality of liquid crystal pixels disposed in a row-column matrix configuration, a line drive circuit sequentially scanning each line of the liquid crystal pixels at every frame repeating with a predetermined frequency, and a column drive circuit writing image signal into the liquid crystal pixels in sync with the sequential scanning, comprising the steps of dividing every frame into a preceding sub-frame and a following sub-frame, performing sequential scanning for the preceding sub-frame and performing sequential scanning again for the following sub-frame, and writing an image signal originally assigned to a frame pertain into the liquid crystal pixels in sync with the sequential scanning for the preceding sub-frame and writing an image signal for adjusting image quality into the liquid crystal pixels in sync with the sequential scanning for the following sub-frame. The image signal for adjusting image quality is obtained by performing a reduction operation on the image signal originally assigned to a frame pertain. Alternatively, an image signal for adjusting image quality, which may be obtained by reducing the image signal originally assigned to a frame pertain by half, may be written into the liquid crystal pixels. Furthermore, the image signals may be written into liquid crystal pixels having a response characteristic of 10 msec or less.

Furthermore, according to an embodiment of the present invention, there is provided a driving method of a liquid crystal display apparatus including a plurality of liquid crystal pixels disposed in a row-column matrix configuration, a line drive circuit sequentially scanning each line of the liquid crystal pixels at every frame repeating with a predetermined frequency, and a column drive circuit writing image signal into the liquid crystal pixels in sync with the sequential scanning, comprising the steps of dividing every frame into a preceding sub-frame and a following sub-frame, performing sequential scanning for the preceding sub-frame and performing sequential scanning again for the following sub-frame, and writing an image signal originally assigned to a frame pertain into the liquid crystal pixels in sync with the sequential scanning for the preceding sub-frame and writing an image signal for adjusting image quality into the liquid crystal pixels in sync with the sequential scanning for the following sub-frame. The image signal for adjusting image quality is set to an image signal representative of a predetermined halftone level. Alternatively, the image signals may be written into liquid crystal pixels having a response characteristic of 10 msec or less.

According to an embodiment of the present invention, a frame is divided into a preceding sub-frame and a following sub-frame. In the preceding sub-frame, an image signal originally assigned to a frame pertain is written into the liquid crystal pixels. In the following sub-frame, an image signal for adjusting image quality, which is different from the image signal originally assigned to the frame pertain, is written into the liquid crystal pixels. The image signal for adjusting image quality is introduced so as to cut out the residual image phenomenon which occurs at an instant of switching from one frame to the next.

According to an embodiment of the present invention, the image signal for adjusting image quality is obtained by using image data relating to a frame pertain and/or a frame next to the frame pertain. Accordingly, the required brightness may be obtained since an image signal representative of a black display is not used for the image signal for adjusting the image quality during the following sub-frame.

Furthermore, according to an embodiment of the present invention, there is provided a driving method of a liquid crystal display apparatus including a plurality of liquid crystal pixels disposed in a row-column matrix configuration, a line drive circuit scanning lines of the liquid crystal pixels at every frame, and a column drive circuit writing image data into the liquid crystal pixels in sync with the line scanning, comprising the steps of dividing every frame into a plurality of sub-frames, performing line scanning for every sub-frame, and writing an image data originally assigned to a frame pertain into the liquid crystal pixels in sync with the line scanning for one of said sub-frames of said frame pertain, and writing an image data for adjusting image quality into the liquid crystal pixels in sync with the line scanning for a sub-frame other than one of the sub-frames; the image data for adjusting the image quality being obtained by operating at least using the image signal originally assigned to the frame pertain.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
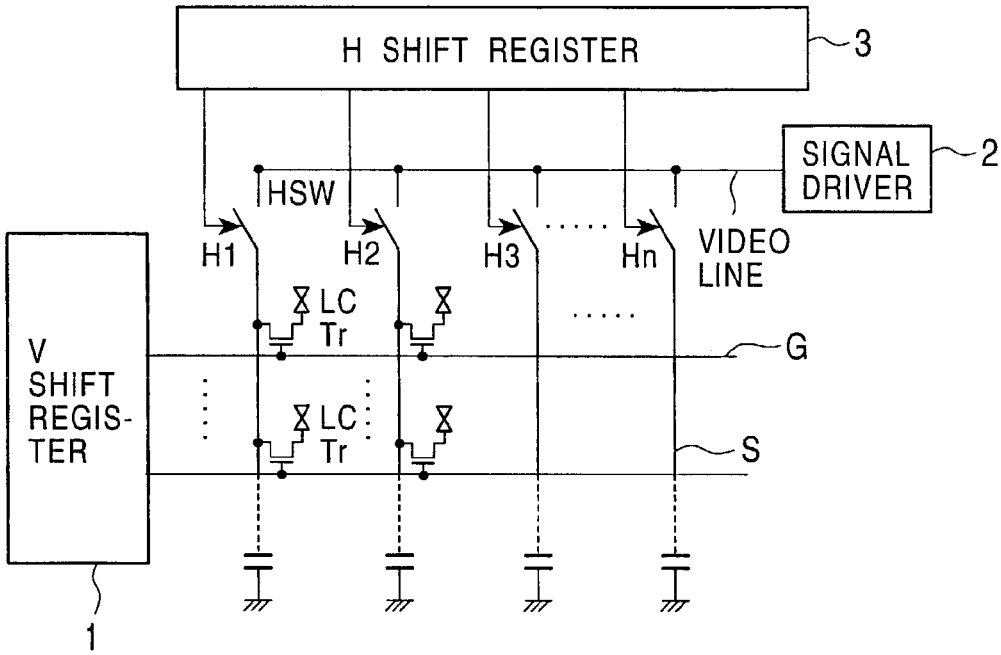
FIG. 1A is a schematic block diagram of a liquid crystal display apparatus in accordance with the present invention.
Figure 1B:
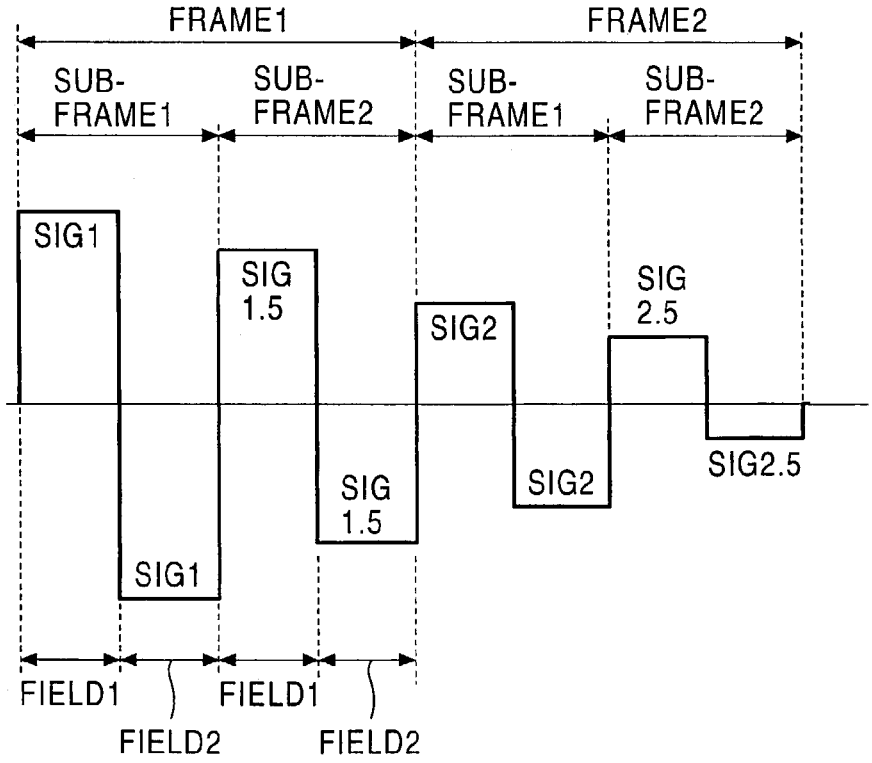
FIG. 1B is a schematic waveform diagram of a liquid crystal display apparatus driving method in accordance with the present invention.

FIGS. 1A and 1B are a schematic diagram of a liquid crystal display apparatus and a schematic waveform diagram of a liquid crystal display apparatus driving method respectively, in accordance with an embodiment of the present invention. As shown in FIG. 1A, the liquid crystal display apparatus comprises liquid crystal pixels (LC) disposed in a row-column manner (matrix configuration), a line drive circuit (V shift register 1 comprising thin film transistors (TFTs)) sequentially scanning each of the lines of the liquid crystal pixels LCs at every repeating frame with a predetermined frequency, and a column drive circuit (signal driver 2 and H shift register 3 comprising TFTs) writing image signal into the liquid crystal pixel LC in sync with the sequential scanning. The image signal indicates image data to be written onto liquid crystal pixels comprising a screen of the liquid crystal display apparatus. The liquid crystal display apparatus with an active matrix type in accordance with the present embodiment comprises gate lines G (e.g. consist of molybdenum (Mo)) disposed in rows, signal lines S (e.g. consist of Aluminum (Al)) disposed in columns, and the liquid crystal pixels LC disposed at intersections of both gate and signal lines whereby arrayed in a row-column matrix manner. The liquid crystal pixel LC is driven by a thin film transistor Tr (for example, consisting of polycrystalline silicon). The V shift register 1 scans each gate line G sequentially from the first line to the last line at every frame period. Accordingly, a set of the liquid crystal pixels LCs disposed in the same single line are selected at a single horizontal period (1H period). The H shift register 3 sequentially samples the image signal for every signal line S during a period 1H, and writes the image signal data into the set of the liquid crystal pixels LCs disposed in the selected single line pixel by pixel. The pixel-by-pixel write-in operation is repeated from the first to the last line whereby the image signals for one frame are written into all the liquid crystal pixels LCs disposed on the screen. Concretely, each signal line S is connected to a video line via a horizontal switch HSW, and receives image signals from the signal driver 2. The H shift register 3 sequentially outputs horizontal sampling pulses H1, H2, H3 . . . , Hn, and controls ON-OFF action of the horizontal switch HSW.

Referring to FIG. 1B, the driving method of the liquid crystal display apparatus in accordance with the present embodiment will now be explained. The V shift register 1 divides a frame into a preceding sub-frame and a following sub-frame. The V shift register 1 executes the sequential scanning process on the preceding sub-frame, and then repeats the sequential scanning process on the following sub-frame. For example, as shown in FIG. 1B, a frame 1 is divided into the preceding sub-frame 1 and the following sub-frame 2. The first sequential scanning process is executed on the sub-frame 1 followed by the second sequential scanning process executed on the following sub-frame 2. Similarly, the next frame 2 is also divided into a sub-frame 1 and a sub-frame 2. And the line sequential scanning process is executed on each of the sub-frames. Every sub-frame is divided into a field 1 and a field 2, and an interlace driving process is executed in a similar way as that of a conventional driving method. In the present embodiment, the frame is divided into two sub-frames. Alternatively, the frame may be divided into three sub-frames or more, in accordance with the present invention. The H shift register 3 writes a regular image signal SIG1, which is originally assigned to the instant frame 1, into the liquid crystal pixels in sync with the line sequential scanning process for the preceding sub-frame 1, and writes an image signal SIG1.5 into the liquid crystal pixels in sync with the line sequential scanning process for the following sub-frame 2. The image signal SIG1.5 is for adjusting image quality, and obtained by operating an image signal SIG2 assigned for the frame 2 and the image signal SIG1 originally assigned for the instant frame 1. The image signal SIG1, SIG1.5, SIG2 or the like are generated by the signal driver 2, and transmitted to the liquid crystal pixels via the video line. Peripheral circuits such as the V shift register 1, the H shift register 3, the signal driver 2 may be integrally fabricated on the substrate on which the liquid crystal pixels are fabricated, or fabricated as separate IC parts and connected with the substrate on which the liquid crystal pixels are fabricated. Alternatively, a semi-conducting substrate may be employed as the substrate in the present invention while an insulating substrate is employed as the substrate in the present embodiment. In the present embodiment, the signal driver 2 generates the image signal SIG1.5 for adjusting image quality obtained by averaging the regular image signal SIG1 originally assigned to the instant frame 1 and the image signal SIG2 assigned to the next frame 2. Then, the signal driver 2 writes the image signal SIG1.5 into the liquid crystal pixels. The driving method described above may be realized by doubling a scanning speed of the V shift register 1 and the H shift register 3 in comparison with conventional technology. Furthermore, the present embodiment may be realized by having a frame memory to store image signal information for a single screen (single frame) so as to enable the operation with image signals of a frame and the next frame to obtain the image signal for adjusting image quality.

Figure 2:
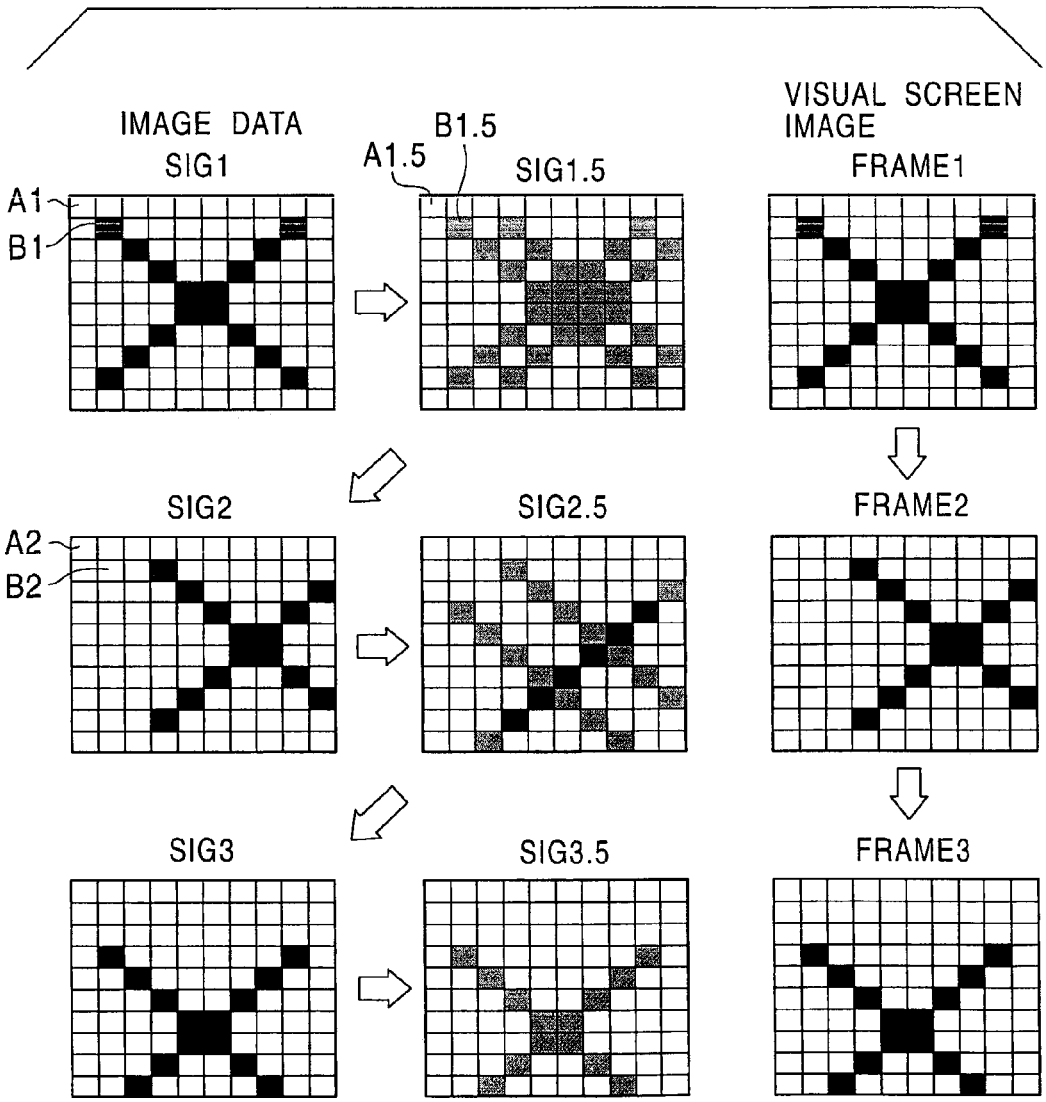
FIG. 2 is a schematic diagram of a liquid crystal display apparatus driving method in accordance with a preferred embodiment of the present invention.
Figure 9:
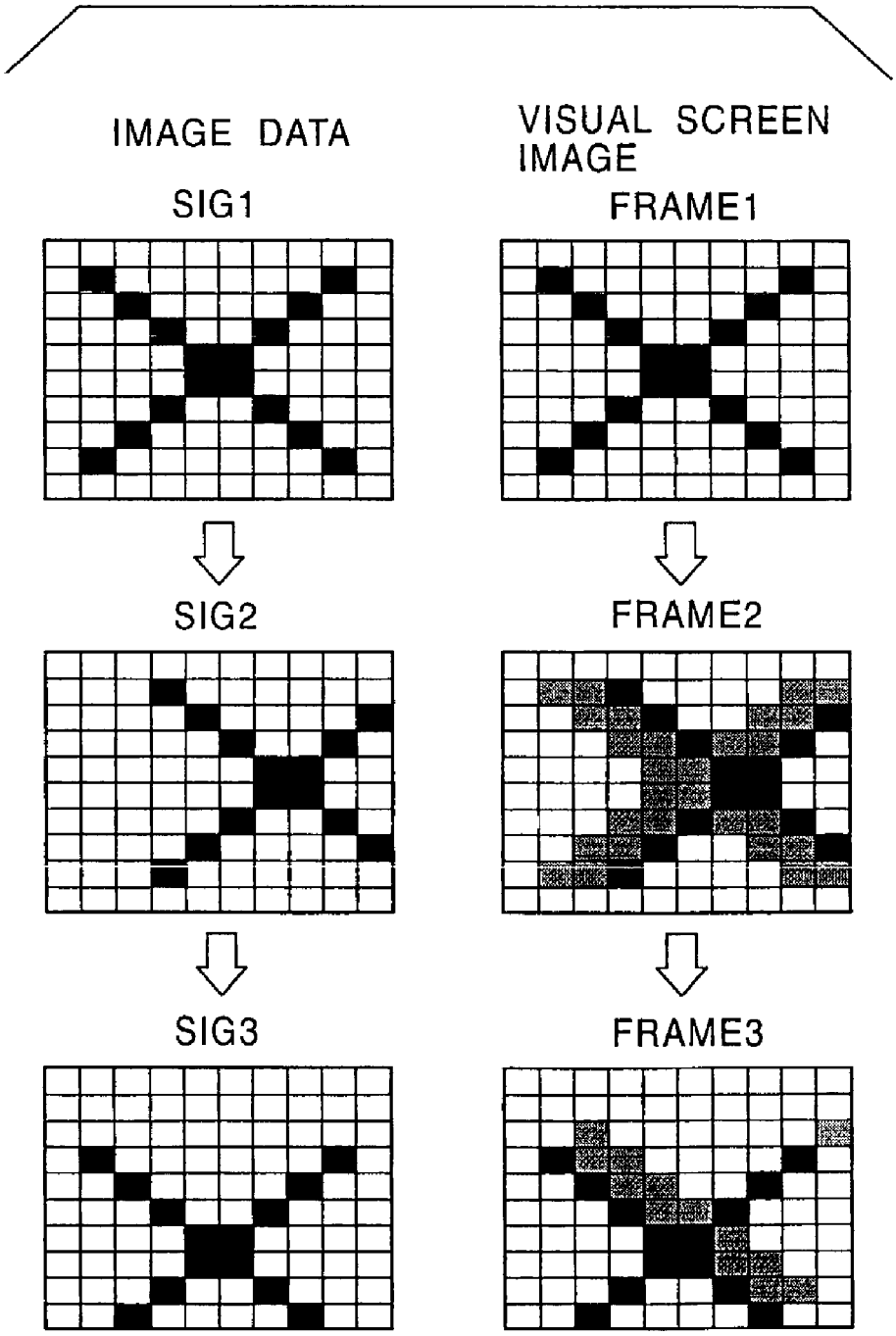
FIG. 9 RELATED ART
FIG. 9 is a schematic diagram of a liquid crystal display apparatus driving method of the related art.
Figure 10:
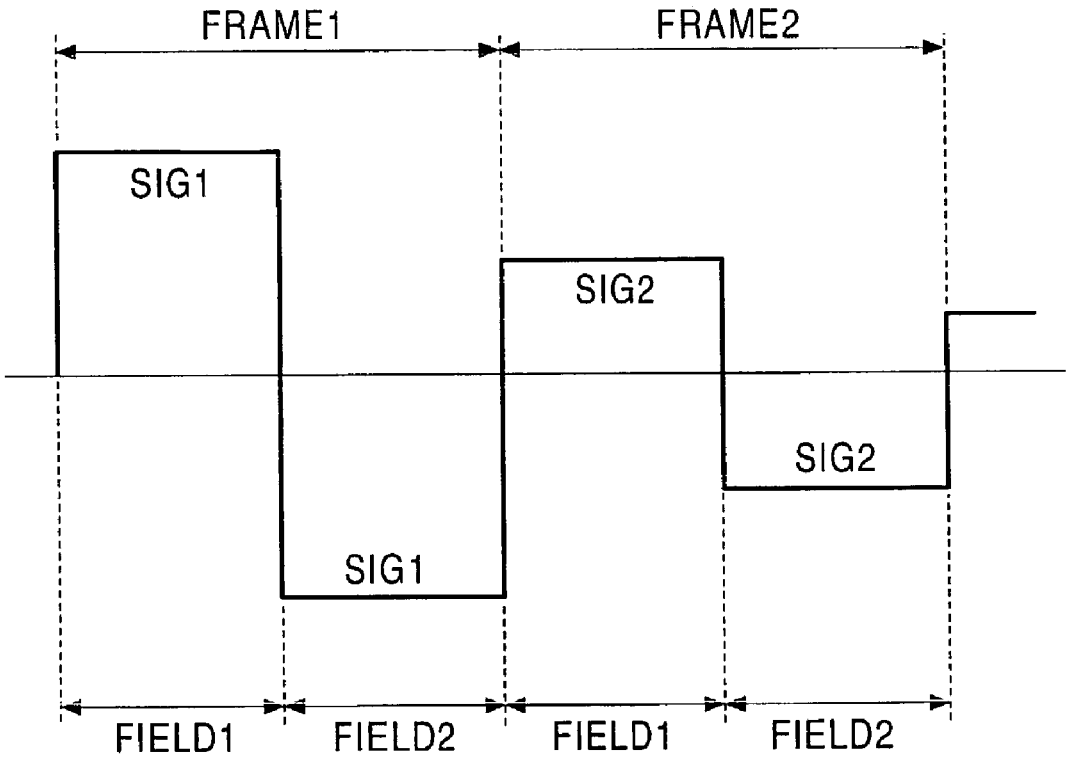
FIG. 10 RELATED ART
FIG. 10 is a schematic waveform diagram of a liquid crystal display apparatus driving method of the related art.

FIG. 2 is a schematic diagram illustrating the driving method shown in FIGS. 1A and 1B. In the figure, the left hand side column of the schematic illustrations show bit map image data of SIG1–SIG3 originally assigned to the frames 1–3, respectively. To help in understanding the following description of the present embodiment, the same format of bit map data as that of the example shown in FIG. 9 is used herein. The right hand side column of the schematic illustrations show visual screen images which may actually be recognized by human eyes at frames 1–3, respectively. In comparison with the related art shown in FIG. 9, it is clear that no residual image phenomenon is observed in the present embodiment. This is because the image signals for adjusting image quality SIG1.5, SIG2.5, SIG3.5 are inserted in the following sub-frame of each frame to cut the residual image, as is shown in the middle column of schematic illustrations in FIG. 2. For example, the image data SIG1 is written in the preceding sub-frame of the frame 1, and the image data SIG2 is written in the preceding sub-frame of the frame 2. The averaged image data SIG1.5 is written in the following sub-frame of the frame 1, which is in the middle of the frame 1 and frame 2. Referring to liquid crystal pixel A disposed in the upper left corner of the screen, which data is designated as data A1 in the frame 1 and data A2 in the frame 2, data A1.5 written in the following sub-frame in the frame 1 is set to an average of the data A1 and A2. In the instant example, the data A1 and A2 are in a white level and then the data 1.5 is set to the white level. In other words, if the image data of the pixel did not change from frame 1 to frame 2, the same image data would be written in the following sub-frame of the frame 1. Accordingly, the image quality of a still-picture is as good as in the conventional one since a part of the screen with still-picture images remains unchanged. Referring to a pixel B in the lower right of the pixel A, image data of the pixel B changes from a black level (B1) at frame 1 to a white level (B2) at frame 2. Accordingly, image data SIG1.5 written in the pixel B at the following sub-frame of the frame 1 is set to a gray level which is an average level of B1 and B2. In the way described above, the residual image phenomenon recognized by the human eyes is alleviated or eliminated by inserting the image data correlated to both the instant frame and the next frame. In the instant example shown in FIG. 2, an explanation is provided for a normally white mode operation. Alternatively, the present invention may also be applicable to a normally black mode operation. Furthermore, the present invention may be applied to both a transmission type and a reflection type liquid crystal display apparatus. When the present invention is employed in the transmission type liquid crystal display apparatus, not only is the moving-picture image characteristic recognized by human eyes improved, but also brightness deterioration is not introduced since display of the white remains the same. Furthermore, contrast deterioration is not introduced since only the part of the display where no electric potential of the image signal is present is changed. Such a part of the display may be, for example, a black displaying part of the moving-picture image as long as the black display is remained the same.

Figure 3A:
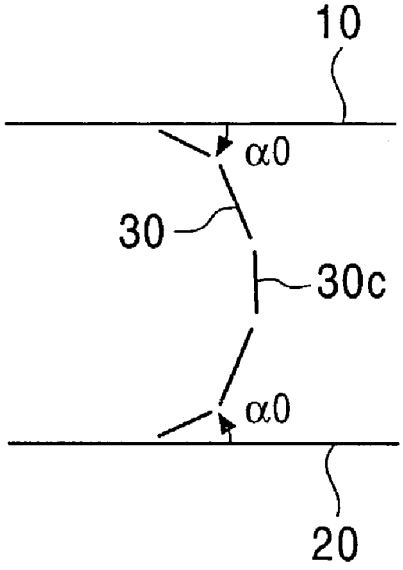
FIGS. 3A and 3B are a schematic illustration of a liquid crystal display apparatus driving method in accordance with a preferred embodiment of the present invention.
Figure 3B:
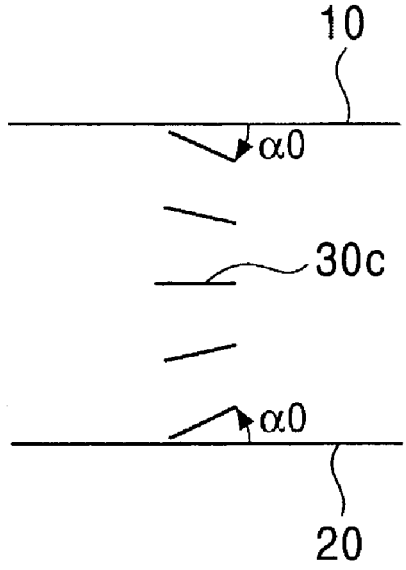

The liquid crystal of the present invention is required to have a response characteristic fast enough to accommodate a driving scheme of the present invention in which a single frame period is divided into a plurality of sub-frames and each of the sub-frames is scanned separately. Accordingly, the liquid crystal with a response characteristic of 10 msec or less is used in the embodiment shown in FIG. 1. More specifically, as shown in FIGS. 3A and 3B, a liquid crystal display panel of an OCB mode (Optically Compensated Bifringence mode) is used. As shown in FIG. 3A, in the OCB mode, liquid crystal molecules 30 disposed in between a pair of electrodes 10, 20 facing each other have a configuration in which the liquid crystal molecules are not twisted, pre-tilt angles of the liquid crystal molecules at the electrode surfaces are $+\alpha$ 0 and $-\alpha$ 0 respectively, and a liquid crystal molecule 30*c* at the center layer of the liquid crystal layer is aligned normal to the electrode surface. This configuration is called a bent orientation, and the upper half and the lower half of the liquid crystal layer constantly have configurations symmetric to each others. The OCB mode is realized when a constant voltage is applied on the electrodes 10, 20. When there is no voltage applied on the electrodes 10, 20, the liquid crystal molecule 30*c* at the center of the liquid crystal layer is aligned parallel to the electrode surfaces as shown in FIG. 3B. This configuration is called a spray orientation. In the OCB mode, a symmetric optical characteristic may be realized even for a slant view angle since the liquid crystal orientation is symmetric with respect to the liquid crystal layer as described above. Furthermore, a display characteristic independent of a view angle may be realized by compensating with a biaxial phase plate. Furthermore, a liquid crystal in the OCB mode has a fast response characteristic in comparison with that of a nematic liquid crystal such as TN and STN using twisted orientations since the liquid crystal in the OCB mode uses the bent orientation which is characterized as having a short response time for an electric field perturbation.

Figure 4:
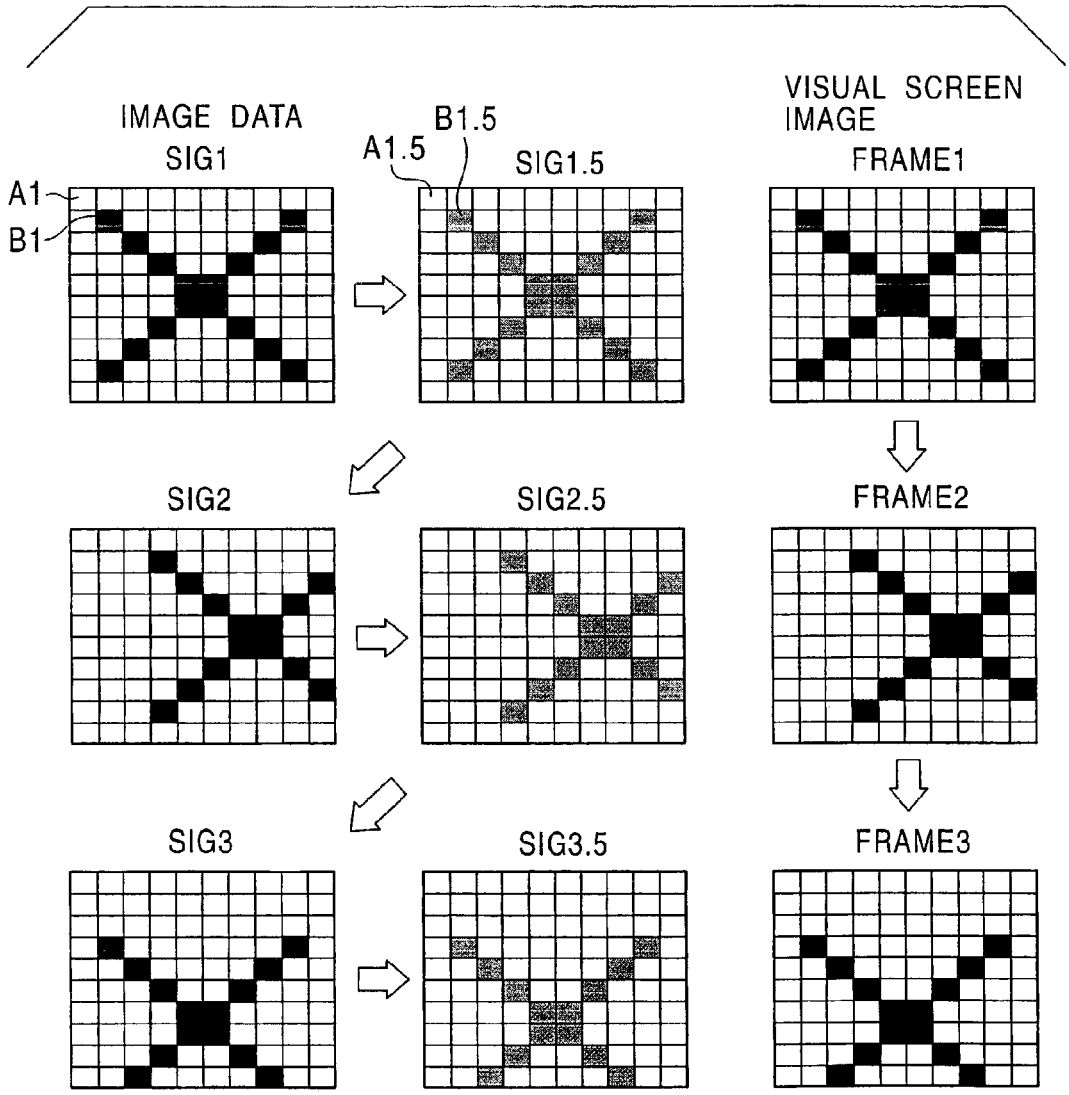
FIG. 4 is a schematic diagram of a liquid crystal display apparatus driving method in accordance with another preferred embodiment of the present invention.

FIG. 4 is a schematic diagram illustrating an example of a driving method of a liquid crystal display apparatus in accordance with another embodiment of the present invention. To help in understanding of the instant embodiment, the same schematic format is used as was used in the previous embodiment described with FIG. 2. Namely, the left hand side column of the schematics illustrates bit map data representative of image data SIG1–SIG3 which are written in the preceding sub-frames of frames 1–3, respectively. The right hand side column illustrates visual screen images recognizable by human eyes in frames 1–3 in which the residual images are alleviated. The center column of the schematics shows bit map data representative of image data SIG1.5, SIG2.5 and SIG3.5 which are inserted in the following sub-frames of frames 1–3, respectively. In the present embodiment, an image signal for the display quality adjustment is calculated by a reduction operation on an image signal assigned to a frame pertain, and written into the liquid crystal pixels. For example, referring to a pixel A at the upper left corner of the screen, image data A1 of the pixel A in the frame 1 is set to white (null potential). Accordingly, image data A1.5 written into the pixel A in the following sub-frame is also white (null potential) since the image data A1.5 is obtained by reducing the image data A1 with a predetermined reduction rate and the image data A1 is set to zero value. Referring to a pixel B disposed at lower right of the pixel A, image data B1 of the pixel B in the frame 1 is set to black corresponding to the maximum potential level. The image data B1 is reduced by the predetermined rate so as to obtain image data B1.5 to be written into the pixel B in the following sub-frame of the frame 1. For example, the image data B1.5 of the gray level is obtained by reducing the black level by half. The reduction rate of 0.5– 0.75 may be set for most of the cases. Accordingly, image data obtained by reducing the image data of a frame pertain with a predetermined reduction rate may be inserted into the following sub-frame of the frame pertain so as to alleviate the residual image phenomenon.

Figure 5:
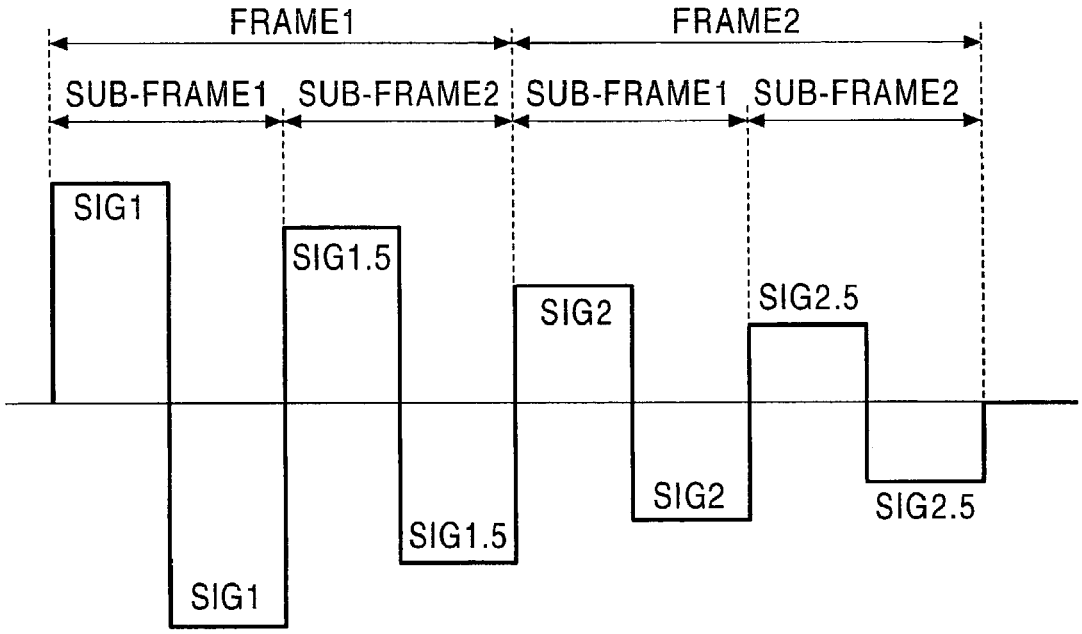
FIG. 5 is a schematic waveform diagram of a liquid crystal display apparatus driving method in accordance with another preferred embodiment of the present invention.

FIG. 5 is a schematic waveform diagram for the embodiment described with FIG. 4. A regular image signal SIG1 is written in the preceding sub-frame 1 of the frame 1 for a period of two fields. Here, the regular image signal is, for example, an image signal directly in correspondence with the image data inputted from outside for display on a screen. The image signal SIG1.5, which is calculated by reducing the image signal SIG1 with the predetermined rate, is written in the following sub-frame 2 for a period of two fields. Similarly, in the next frame 2, the regular image signal SIG2 is written into the pixels during the preceding sub-frame 1, and the image signal SIG2.5, which is obtained, for example, by reducing the regular image signal SIG2 by half, is written into the pixels during the following sub-frame 2.

Figure 6:
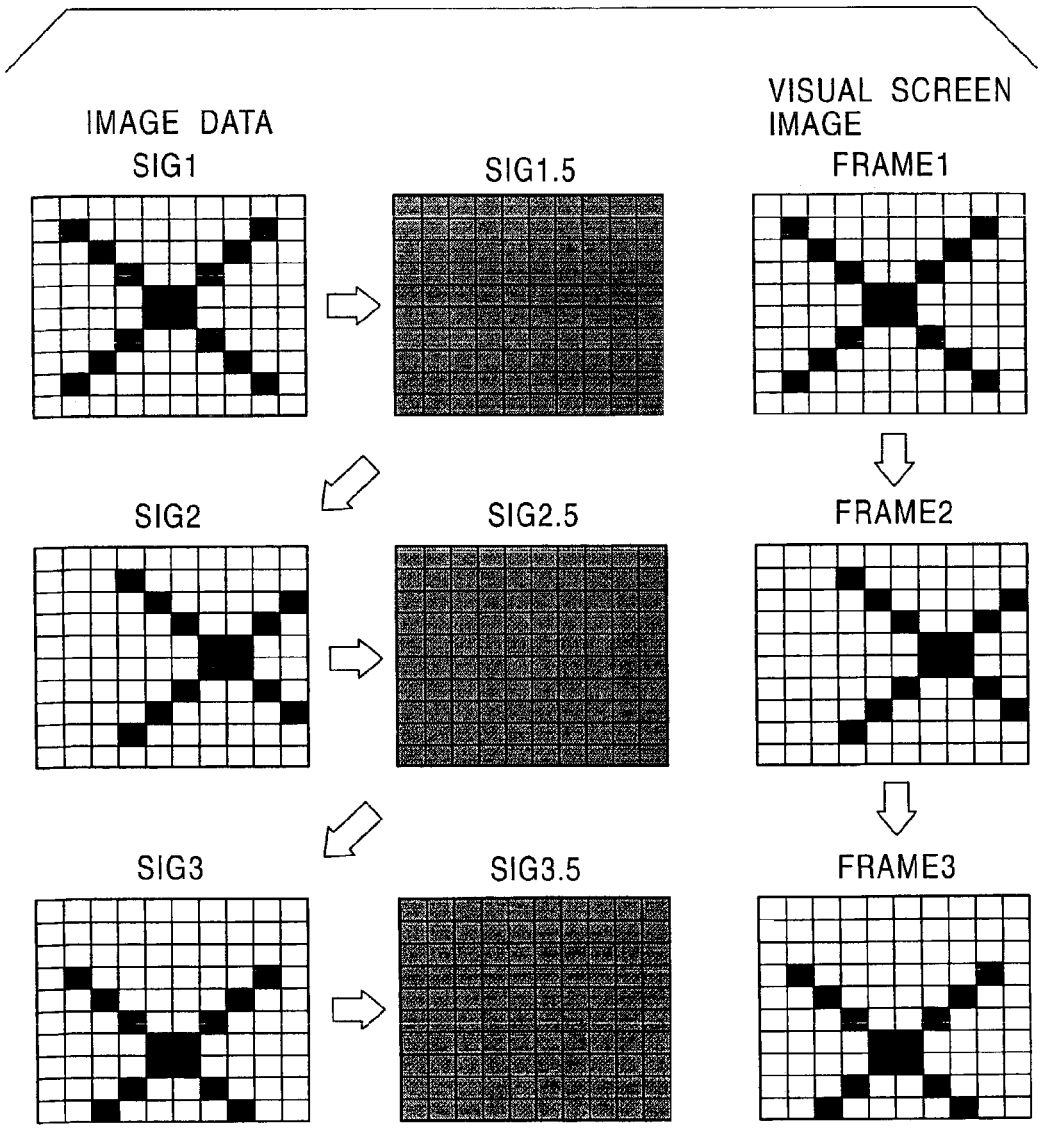
FIG. 6 is a schematic diagram of a liquid crystal display apparatus driving method in accordance with still another preferred embodiment of the present invention.

FIG. 6 is a schematic diagram illustrating an example of a driving method of a liquid crystal display apparatus in accordance with another embodiment of the present invention. To help understanding of the instant embodiment, the same schematic format is used as was used in the previous embodiments described in FIGS. 2 and 4. In the present embodiment, the regular image data is written into the liquid crystal pixels in the preceding sub-frame of every frame while the image signal for the display quality adjustment with the same halftone level is written into all of the liquid crystal pixels in the following sub-frame of every frame. In contrast to the previous embodiments of FIGS. 2 and 4, no field memory is required in the driving method of the present embodiment since no operation of the image signal is executed. The example shown in FIG. 6 is in the normally white mode. Alternatively, the present embodiment may be applied to the normally black mode. It is more effective to write image data of black into all the pixels of the screen during the following sub-frame of every frame to eliminate the residual image phenomenon among frames. However, a time-average brightness of the screen may not be enough in some cases when the black image data is written. Accordingly, the same halftone level is written into all of the liquid crystal pixels during the following sub-frame of every frame in the present embodiment, and the black level is not used.

Figure 7:
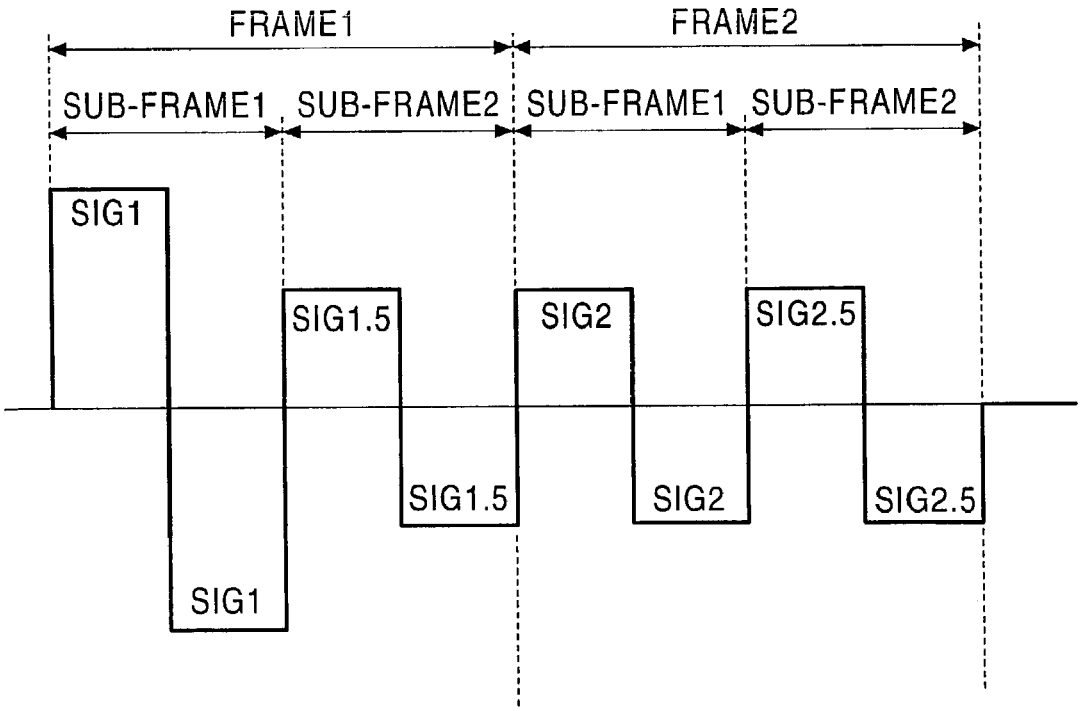
FIG. 7 is a schematic waveform diagram of a liquid crystal display apparatus driving method in accordance with still another preferred embodiment of the present invention.
Figure 8:
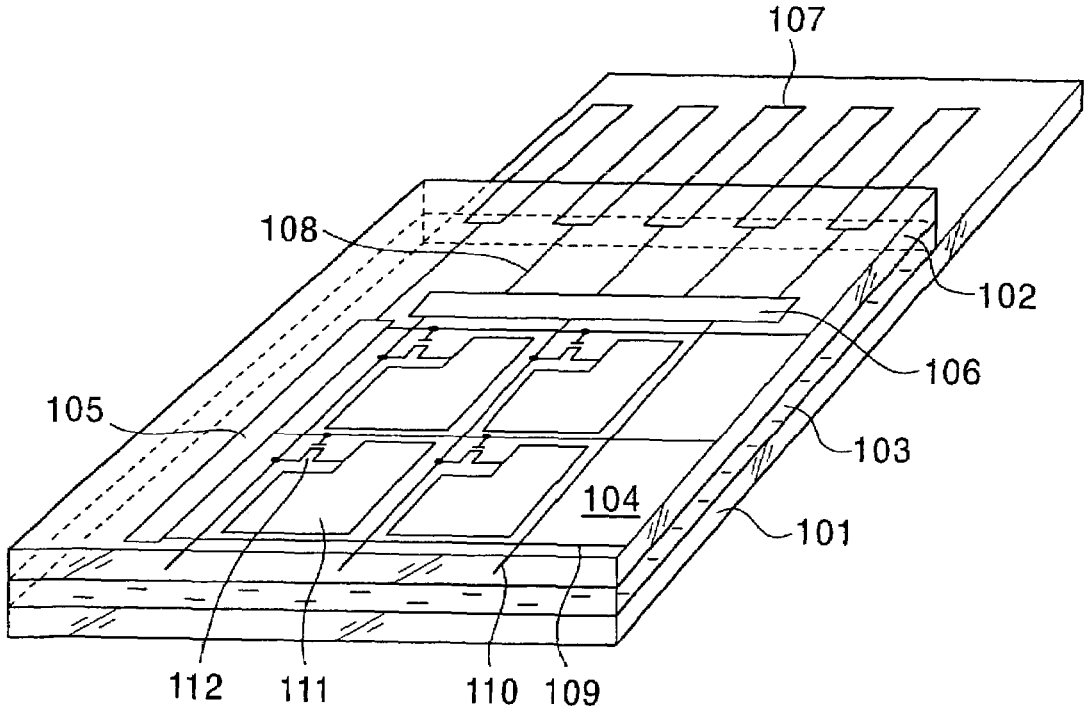
FIG. 8 RELATED ART
FIG. 8 is a perspective diagram of a liquid crystal display apparatus of the related art.

FIG. 7 is a schematic waveform diagram for the embodiment described in FIG. 6. The regular image signal SIG1 is written in the preceding sub-frame 1 of the frame 1 for a period of two fields. The image signal SIG1.5, which is representative of the same predetermined halftone signal voltage, is written into all the liquid crystal pixels in the following sub-frame 2. Similarly, in the next frame 2, the regular image signal SIG2 is written during the preceding sub-frame 1, and the image signal SIG2.5 for the image quality adjustment representative of the halftone is written into all the pixels during the following sub-frame 2.

Accordingly, the present invention enables the improvement of image quality of a moving-picture in the active matrix type liquid crystal display apparatus by dividing a single frame into a plurality of sub-frames and writing another image signal into a sub-frame which is different from the first sub-frame of a frame. Another image signal may be obtained by operating a potential value of an image signal in a frame pertain and/or a potential value of an image signal in the next frame. Alternatively, a particular halftone potential value may be used as another image signal, and the same halftone potential value may be written into all the liquid crystal pixels of the screen. Particularly, superior display quality may be realized without deteriorating the moving-picture image contrast nor the averaged brightness when another image signal to be inserted is obtained through the operation using image signals of the instant frame and the next frame.

What is claimed is:

1. A driving method of a liquid crystal display apparatus including a plurality of liquid crystal pixels disposed in a row-column matrix configuration, a line drive circuit sequentially scanning each line of said liquid crystal pixels at every frame repeating with a predetermined frequency, and a column drive circuit writing an image signal into said liquid crystal pixels in sync with said sequential scanning, comprising the steps of:

dividing said every frame into a preceding sub-frame and a following sub-frame, performing said sequential scanning for said preceding sub-frame, and performing said sequential scanning again for said following sub-frame, and writing an image signal originally assigned to a frame pertain into said liquid crystal pixels in sync with said sequential scanning for said preceding sub-frame, and writing an image signal for adjusting image quality into said liquid crystal pixels in sync with said sequential scanning for said following sub-frame, said image signal for adjusting image quality being obtained by performing a reduction operation on said image signal originally assigned to a frame pertain, wherein:

said image signal for adjusting image quality, which is obtained by reducing said image signal originally assigned to a frame pertain by half, is written into said liquid crystal pixels.

2. A driving method of a liquid crystal display apparatus according to claim 1, wherein:

said image signals are written into said liquid crystal pixels having a response characteristic of 10 msec or less.

3. A liquid crystal display apparatus including a plurality of liquid crystal pixels disposed in a row-column matrix configuration, a line drive circuit sequentially scanning each line of said liquid crystal pixels at every frame repeating with a predetermined frequency, and a column drive circuit writing an image signal into said liquid crystal pixels in sync with said sequential scanning, wherein:

said every frame is divided into a preceding sub-frame and a following sub-frame, said line drive circuit performs said sequential scanning for said preceding sub-frame, and performs said sequential scanning again for said following sub-frame, and said column drive circuit writes an image signal originally assigned to a frame pertain into said liquid crystal pixels in sync with said sequential scanning for said preceding sub-frame, and writes an image signal for adjusting image quality into said liquid crystal pixels in sync with said sequential scanning for said following sub-frame, said image signal for adjusting image quality being obtained by performing a reduction operation on said image signal originally assigned to a frame pertain, wherein:

said column drive circuit writes said image signal for adjusting image quality, which is obtained by reducing said image signal originally assigned to a frame pertain by half, into said liquid crystal pixels.

4. A liquid crystal display apparatus according to claim 3, wherein:

said liquid crystal pixels have a response characteristic of 10 msec or less for an image signal to be written.

* * * * *